US006663220B2

(12) United States Patent
Suzuki et al.

(10) Patent No.: US 6,663,220 B2
(45) Date of Patent: Dec. 16, 2003

(54) INK JET PRINTER

(75) Inventors: Atsushi Suzuki, Tagata-gun (JP); Takuro Ito, Sunto-gun (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 43 days.

(21) Appl. No.: 09/921,568

(22) Filed: Aug. 6, 2001

(65) Prior Publication Data

US 2002/0024552 A1 Feb. 28, 2002

(30) Foreign Application Priority Data

Aug. 28, 2000 (JP) ..... 2000-257238

(51) Int. Cl.[7] ..... B41J 1/165

(52) U.S. Cl. ..... 347/36; 347/85; 347/86; 347/87; 347/88; 347/89

(58) Field of Search ..... 347/36, 85–89, 347/30, 92, 6, 7

(56) References Cited

U.S. PATENT DOCUMENTS 4,317,124 A * 2/1982 Shirato et al. ..... 347/67
4,476,472 A * 10/1984 Aiba et al. ..... 346/75
5,523,778 A * 6/1996 Fickling ..... 347/76
5,963,237 A * 10/1999 Ikkatai et al. ..... 347/85
6,152,559 A * 11/2000 Kojima ..... 347/89
6,152,560 A * 11/2000 Hollands ..... 347/93
6,312,094 B1 * 11/2001 Ito et al. ..... 347/36
6,328,437 B1 * 12/2001 Mihara et al. ..... 347/86
6,412,929 B1 * 7/2002 Chen ..... 347/85

FOREIGN PATENT DOCUMENTS

JP 10-006521 1/1998

* cited by examiner

*Primary Examiner*—Stephen D. Meier
*Assistant Examiner*—Ly T Tran
(74) *Attorney, Agent, or Firm*—Oblon, Spivak, McClelland, Maier & Neustadt, P.C.

(57) ABSTRACT

A discharge port is formed in a bottom surface of ink tank. The ink tank is made to communicate with a waste ink tank by connecting the discharge port to the waste ink tank in a position lower than the discharge port, and a part of connection member is openable/closable by a valve. If the connection member is opened, ink is discharged from the discharge port of the ink tank to the waste ink tank. If impurities are deposited on the bottom surface of the ink tank, the impurities can be discharged with ink from the discharge port to the waste ink tank, thereby clogging in the nozzle head due to impurities can be reliably prevented.

12 Claims, 6 Drawing Sheets

INK JET PRINTER

CROSS REFERENCE TO RELATED APPLICATION

The present application is based on Japanese Priority Document 2000-257238 filed Aug. 28, 2000, the content of which is incorporated herein by reference.

BACKGROUND OF THE INVENTION

1. Field of the Invention

The present invention relates to an ink jet printer which performs printing by discharging ink supplied from nozzle head ink tank having plural ink jet nozzles from selected ink jet nozzles, on a print medium.

2. Discussion of the Background

Conventionally known is a line type ink jet printer which performs printing at a greatly-improved printing speed in comparison with a so-called serial type ink jet printer and performs continuous print operation on a large number of print sheets. This line type ink jet printer can perform continuous printing on, e.g., 500 or more sheets.

In the continuous printing on a large number of print sheets, if only an unincreasable-sized ink cassette (i.e. a small ink cassette) is used as in the case of the conventional serial type ink jet printer where the size of the ink cassette cannot be increased due to a reciprocating movement in a line direction, the ink becomes short.

In the ink jet printer that performs continuous print operation on e.g. 500 or more print sheets, a removable large-capacity ink cartridge is provided, and ink is supplied from the ink cartridge to the ink tank whenever necessary, thereby frequent ink cassette change as in the case of the conventional small ink cassette is unnecessitated and continuous print operation for a long period is realized.

In addition, in this ink jet printer, a removable waste ink tank is provided in a fixed position, and upon maintenance of a nozzle head, ink discharged from the nozzle head is collected into the waste ink tank.

In this large-capacity line type ink jet printer, attachment of ink tank and piping are complicated, assembly thereof is troublesome and the number of processes is large. Accordingly, the ink tank cannot be easily changed. If the printer is used for a long period without changing the ink tank, impurities such as dirt mixed in ink supplied from the ink cartridge to the ink tank and chemical compound of the ink itself (hereinbelow referred to as "impurities") are deposited on the bottom of the ink tank.

As the impurities supplied from the ink tank to the nozzle head cause clogging in the nozzle head, the conventional ink jet printers have various arrangements to prevent the entry of the impurities into the nozzle head.

As an example of arrangement to prevent the entry of the impurities into the nozzle head, an ink supply port from the ink tank to the nozzle head is provided in a position higher than the bottom surface of the ink tank such that the impurities are deposited in a predetermined area. In this case, the impurities reach the supply port in time and the impurities are supplied to the nozzle head. To prevent this inconvenience, the capacity of the ink tank may be increased so as to increase the impurity depositing area. However, if the capacity of the ink tank is increased, the ink jet printer itself is enlarged. Therefore, this arrangement cannot be the best solution.

Further, as another arrangement to prevent the entry of the impurities into the nozzle head, a filter is provided inside the ink tank. However, in this case, as the impurities are deposited inside the filter, the inside space of the filter is filled with the impurities in time, and ink supply to the nozzle head might be disturbed.

SUMMARY OF THE INVENTION

Accordingly, an object of the present invention is to provide an ink jet printer which reliably prevents clogging in a nozzle head due to impurities.

The object of the present invention is achieved by the novel ink jet printer head of the present invention.

According to the novel ink jet printer of the present invention, a discharge port formed in the bottom surface of ink tank is connected by a connecting member to a waste ink tank to collect waste ink produced upon nozzle head maintenance, and a part of the connecting member is freely opened/closed by a valve.

Another aspect of the novel ink jet printer head of the present invention, the discharge port formed in the bottom surface of ink tank is connected by connecting means to waste ink tank for collecting waste ink produced upon nozzle head maintenance, and a part of the connecting means is freely opened/closed by a valve.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Preferred embodiments of the present invention will now be described in detail in accordance with the accompanying drawings.

First Embodiment

A first embodiment of the present invention will be described with reference to FIGS. 1 to 4.

An ink jet printer according to the present embodiment is applied to a line type color ink jet printer which performs line-directional printing by discharging ink from respective color ink jet nozzles on a rotating print medium, and performs column-directional printing by utilizing the rotation of drum during forward-movement by an ink jet nozzle pitch.

Figure 1:
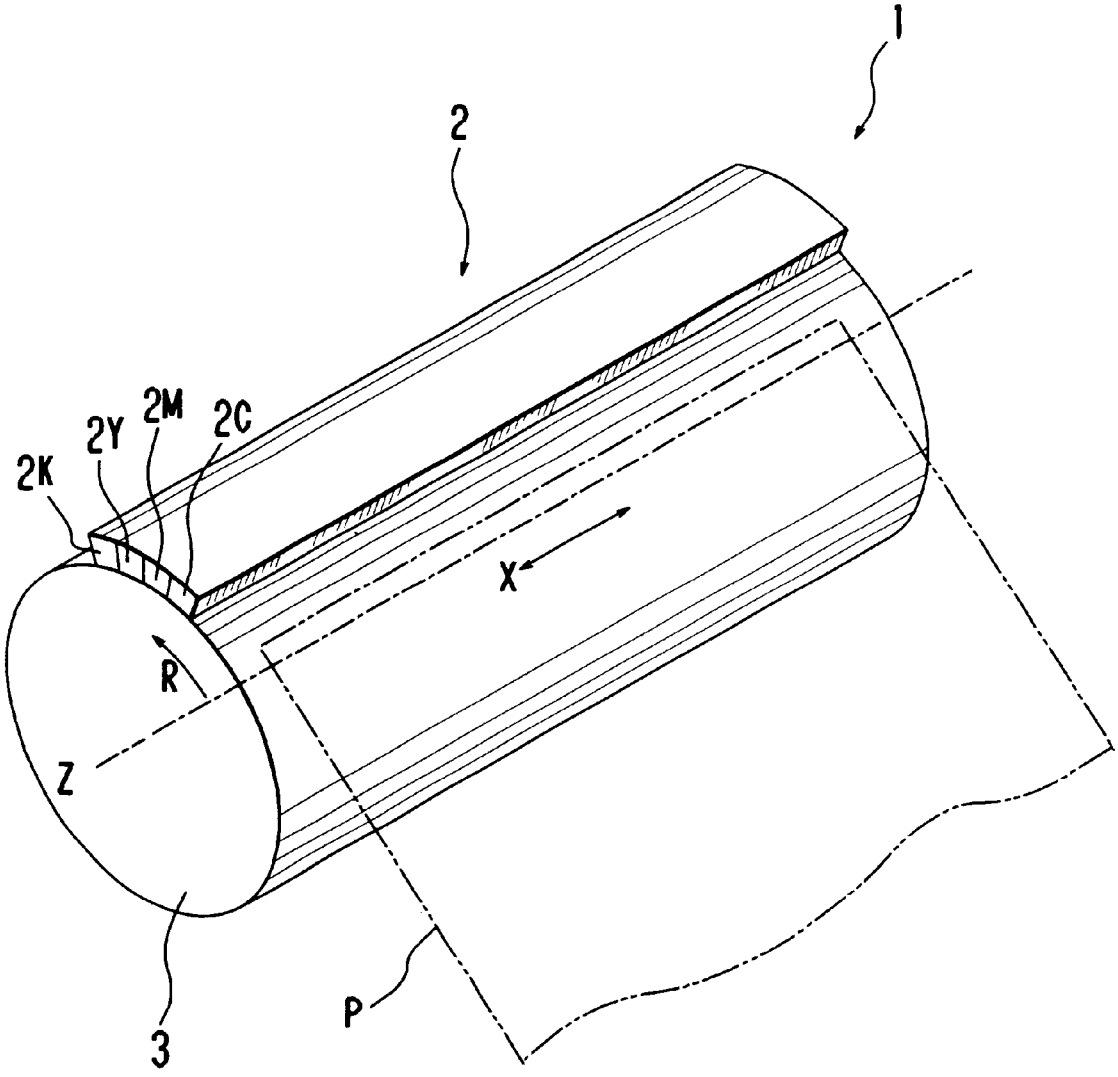
FIG. 1 is an explanatory view of a printing method of an ink jet printer according to a first embodiment of the present invention.
Figure 2:
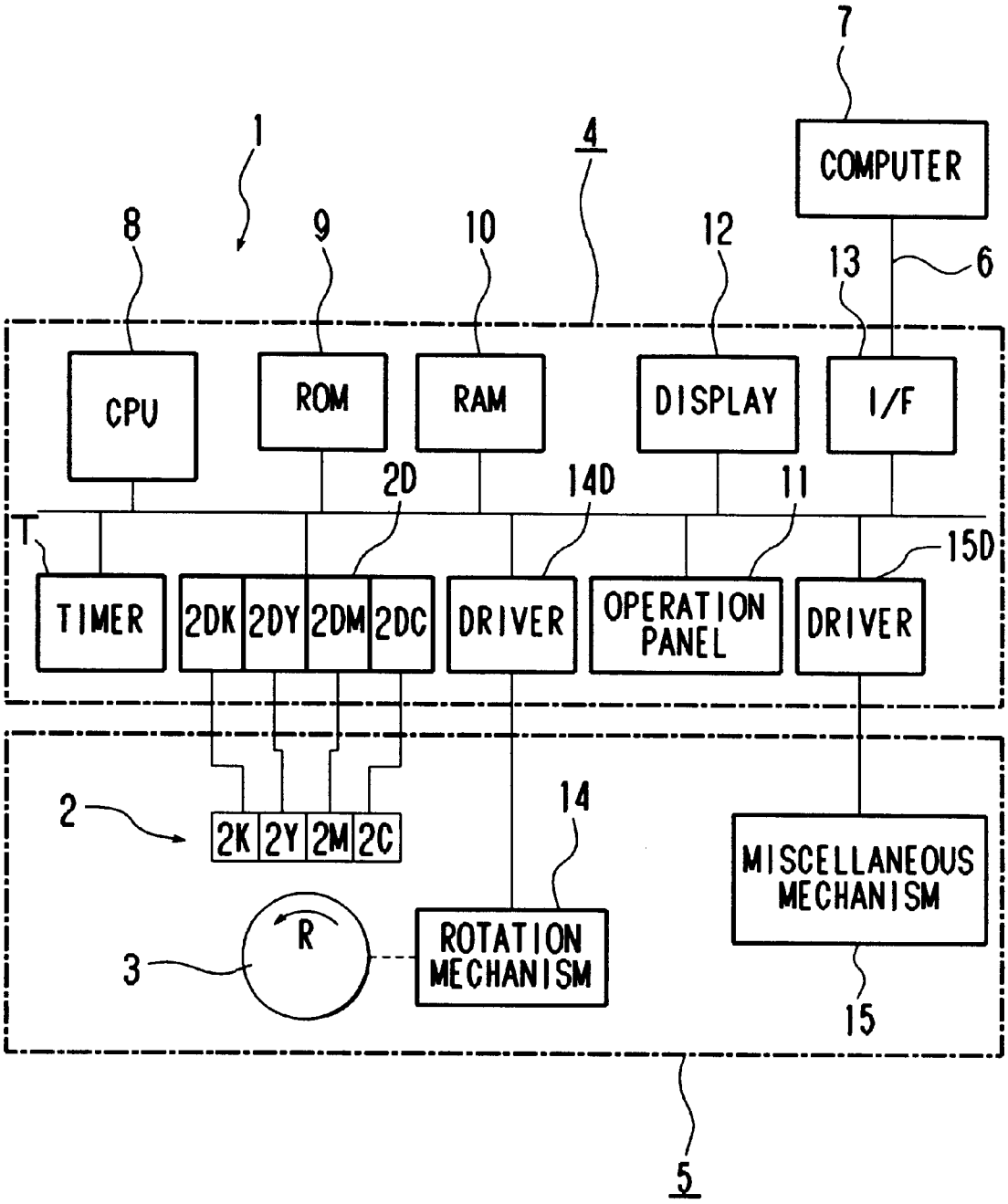
FIG. 2 is a block diagram showing electrical connection among respective elements of the ink jet printer.

Note that FIG. 1 is an explanatory view of printing method of an ink jet printer 1, and FIG. 2, a block diagram showing electrical connection among respective elements of the ink jet printer. As shown in FIG. 1, the ink jet printer 1 has respective color nozzle heads 2C, 2M, 2Y and 2K integrated as a nozzle unit 2 along the length of the unit in a main-scanning (X) direction (or integrated plural nozzle head elements arrayed in the line direction). The line-directional printing on a rotating print medium (e.g., a print sheet P) is performed by supplying respective color ink to the respective color ink jet nozzles while resiprocatively moving the nozzle unit by the ink jet nozzle pitch and discharging the ink from selected ink jet nozzles, and the column-directional printing is performed by utilizing the rotation of a rotary member 3 in a direction R on an axial line Z during forward-movement by the ink jet nozzle pitch. That is, in the ink jet printer 1 capable of simultaneously performing the low-directional printing and the column-directional printing, the print speed can be greatly improved. Note that in the present embodiment, the nozzle unit 2 has nozzle heads for 4 colors (cyan (C), yellow (Y), magenta (M) and black (K)), however, it may be arranged such that the nozzle unit 2 has only a nozzle head for 1 color (e.g., black (K)).

As shown in FIG. 2, the ink jet printer 1 formed with an image processor 4 and an engine 5 performs print processing on print data generated in the image processor 4 based on a print command generated in the image processor 4. Note that it may be arranged such that the ink jet printer 1 constructs an ink jet print system where print processing is performed on print data, transmitted from an external computer 7 via a data communication line (e.g. LAN) 6, based on a print command from the computer.

The image processor 4 includes a CPU (Central Processing Unit) 8 which controls the respective elements, a ROM (Read Only Memory) 9 for storing control programs and the like, a RAM (Random Access Memory) 10 for rewritably storing variable data, an operation panel 11, a display unit 12, an interface (I/F) 13, a timer T for time measurement, and the like. The image processor 4 performs processing to convert print data into bitmap data and outputs the data to an engine 5, and the like, and drive controls the ink jet printer 1 by an appropriate amount at appropriate timing.

Note that in FIG. 1, head drivers 2DC, 2DM, 2DY and 2DK of the nozzle unit 2 (2C, 2M, 2Y and 2K), a driver 14D for a rotation mechanism 14 to drive the rotary member 3, another mechanism 15 to be described later, and the like, are arranged in the image processor 4 for the sake of convenience.

The engine 5 has the rotary member 3 which holds a print medium (print sheet P) fed from print medium feeding means (not shown) on its peripheral surface, the rotation mechanism 14 which rotates the rotary member 3 at a predetermined rotational speed (e.g. 120 rpm), the print medium feeding means and print medium discharge means (not shown), and another mechanism 15 including a maintenance mechanism (not shown) and the like, as well as the above-described nozzle unit 2. The engine 5 is capable of performing color printing and monochrome printing. Note that another mechanism 15 also includes a drive mechanism (not shown) which drives a tube pump 20 of ink supply means 16 for supplying the respective color ink to the nozzle unit 2, a suction pump 29 of waste ink collection means 23 and a tube pump 28 (all shown in FIG. 3) to be described in detail later.

More specifically, the print medium (print sheet P), transmitted from the print medium supply means in a main body case, is supplied to the rotary member 3 side rotating in the direction R at predetermined timing, and held around the peripheral surface of the rotary member 3 by utilizing e.g. electrostatic attraction. Note that in a feeding path from the print medium feeding means to the rotary member 3, up to 2 print sheets can be held in waiting before delivery of print sheet to the rotary member 3. Further, the rotary member 3 holds one print medium (print sheet P).

Figure 3:
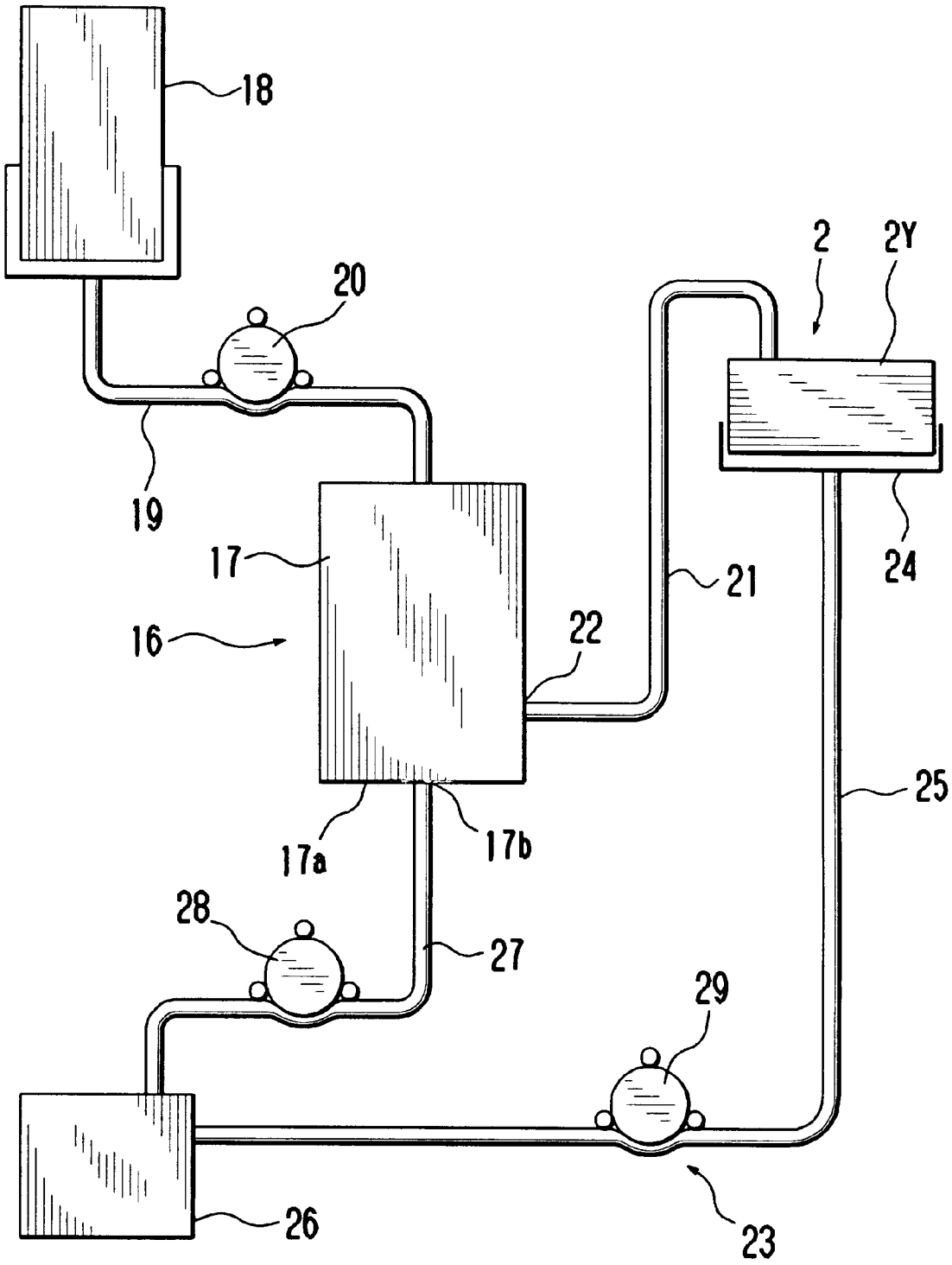
FIG. 3 is an explanatory view of ink flow path in the ink jet printer.

Next, the nozzle unit 2, the ink supply means 16, the waste ink collection means 23 and its peripheral portion will be described in detail with reference to FIG. 3 showing an ink flow path in the ink jet printer 1. As shown in FIG. 3, the ink supply means 16 that supplies respective color ink to the respective nozzle heads 2C, 2M, 2Y and 2K forming the nozzle unit 2 (FIG. 3 shows only the nozzle head 2Y) is constructed with ink tanks 17 (FIG. 3 shows only a yellow ink tank), a removably-provided ink cartridge 18 for ink replenishing, a connection tube 19 to replenish ink in the ink cartridge 18 to the ink tanks 17 when necessary, the tube pump 20 having a valve function for selecting an open state or a closed state of the connection tube 19, a supply tube 21 as a first connection member to supply ink in the ink tank 17 to ink chambers (not shown) of the nozzle heads 2C, 2M, 2Y and 2K forming the nozzle unit 2, and the like. Note that the capacity of the ink cartridge 18 is larger (e.g. 200 $cm^3$ or greater) than that of the conventional small ink cassette (10 to 20 $cm^3$). Further, the supply tube 21 is connected to an ink supply port 22 provided in a side surface of the ink tank 17 in a position higher than a bottom surface 17*a* of the ink tank 17 by a predetermined distance. Further, the respective color ink tanks 17 (specifically ink liquid surfaces) are set in positions lower than ink discharge orifices of the respective color nozzle heads 2C, 2M, 2Y and 2K of the nozzle unit 2. In this arrangement, a constant negative pressure is applied to ink in the ink chambers (not shown) of the respective color nozzle heads 2C, 2M, 2Y and 2K of the nozzle unit 2, thereby ink leakage can be prevented by the tare.

Further, the respective distances in heights between the respective color ink tanks 17 (specifically ink liquid surfaces) and the respective color nozzle heads 2C, 2M, 2Y and 2K of the nozzle unit 2 are fine adjusted in accordance with respective ink characteristics for performing printing in higher quality in a stable manner by uniforming ink jet characteristics (meniscus).

Note that the ink liquid surface in the ink tank 17 is always adjusted in a constant state by liquid surface stabilizing means (not shown).

Note that the ink jet printer 1 is further provided with the maintenance mechanism (not shown) for maintaining excellent ink discharge characteristics in the respective color nozzle heads 2C, 2M, 2Y and 2K of the nozzle unit 2. The maintenance mechanism is connected to the waste ink collection means 23. The waste ink collection means 23 has a cap 24 to cover the respective color nozzle heads 2C, 2M, 2Y and 2K of the nozzle unit 2 upon maintenance, a suction tube 25, the suction pump 29 and a waste ink tank 26. The waste ink collection means 23 collects the ink in the respective color nozzle heads 2C, 2M, 2Y and 2K of the nozzle unit 2 by driving the suction pump 29 to suck the ink while the nozzle unit 2 is covered with the cap 24, and collects the sucked ink (waste ink) into the waste ink tank 26 communicating with the cap 24 via the suction tube 25. Note that the waste ink tank 26 is removably provided in a predetermined position.

In addition, a discharge port 17*b* is provided in the bottom surface 17*a* of the ink tank 17 of the ink jet printer 1 for discharging impurities deposited inside the ink tank 17 to the above-described waste ink tank 26. The discharge port 17*b* communicates with the waste ink tank 26 via a connection tube 27 as second connection member and connection means.

Further, the connection tube 27 is provided with the tube pump 28 having a valve function of selecting an open state or a closed state of the connection tube 27.

In the present embodiment, the tube pumps 20 and 28 provided in two positions have structures where projections 20*b* and 28*b* are provided in 3 positions around cylindrical base portions 20*a* and 28*b*, and the base portions 20*a* and 28*b* are rotate-driven. In the tube pumps 20 and 28, the projections 20*b* and 28*b* press the connection tubes 19 and 17 by the rotation of the base portions 20*a* and 28*b*, thereby the connection tubes 19 and 17 are changed from the open state to the closed state.

In the arrangement, the ink in the ink cartridge 18 is replenished to the ink tanks 17 by the tube pump 20. When ink is discharged by control of the CPU 8 from the respective color nozzle heads 2C, 2M, 2Y and 2K of the nozzle unit 2 on a print medium (print sheet P), the ink in the ink tanks 17 is automatically supplied to the ink chambers of nozzle head that discharged ink via a supply tube 21 from the ink tank 17 by a capillary phenomenon by the decrement due to the ink discharge.

On the other hand, impurities mixed with the ink supplied from the ink cartridge 18 to the ink tank 17 are deposited on the bottom surface 17*a* of the ink tank 17.

Next, as a function executed by the CPU 8 based on the control program stored in the ROM 9, characteristic of the ink jet printer 1 of the present embodiment, impurity discharge processing to eliminate impurities deposited on the bottom surface 17*a* of the ink tank 17 will be described.

Figure 4:
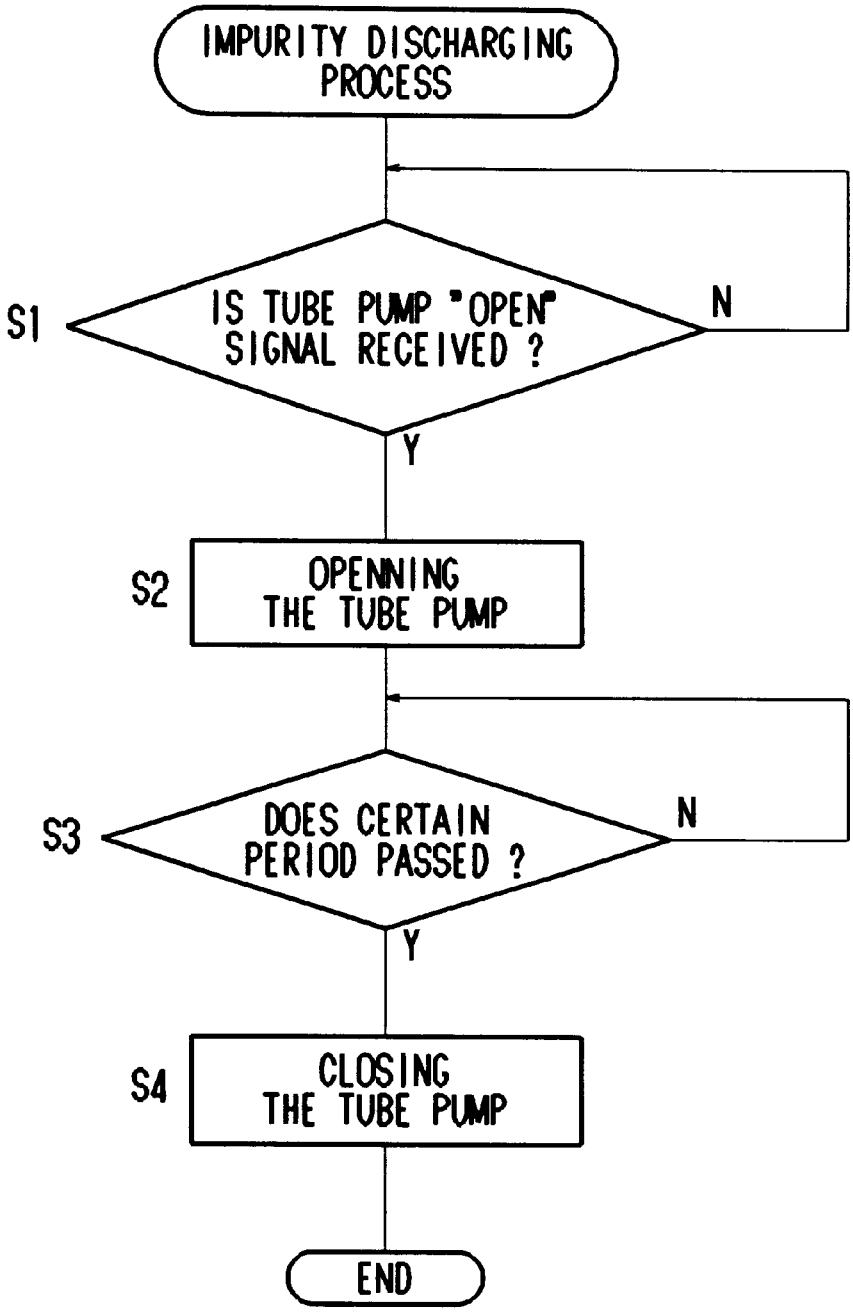
FIG. 4 is a flowchart schematically showing the flow of impurity discharge processing.

FIG. 4 is a flowchart schematically showing the flow of the impurity discharge processing. As shown in FIG. 4, in the impurity discharge processing, first, reception of "tube pump 'open' signal" to rotate the tube pump 28 to set the connection tube 27 to the open state is waited (step S1). The "tube pump 'open' signal" is generated when a maintenance operation is performed in the nozzle unit 2, when a predetermined number of print sheets have been print-outputted, when the impurity discharge processing is declared by operation at the operation panel 11, or the like.

When the "tube pump 'open' signal" has been received (Y at step S1), the tube pump 28 is rotated to set the connection tube 27 to the open state (step S2). When the connection tube 27 is in the open state, the impurities deposited on the bottom surface 17*a* of the ink tank 17 flow with ink from the discharge port 17*b* provided in the bottom surface 17*a* of the ink tank 17 via the connection tube 27 into the waste ink tank 26. Note that the open state of the connection tube 27 is maintained until it is determined by time measurement of the timer T that a predetermined period has elapsed (Y at step S3).

Then, if the predetermined period has elapsed (Y at step S3), the tube pump 28 is rotated to set the connection tube 27 to the closed state (step S4), to stop the discharge of the impurities from the discharge port 17*b*.

That is, in the impurity discharge processing at steps S1 to S4, the function of the opening/closing selection means is performed.

If the impurities are deposited on the bottom surface 17*a* of the ink tank 17, as the tube pump 28 is rotated to set the connection tube 27 to the open state, the impurities can be discharged with the ink from the discharge port 17*b* of the ink tank 17 to the waste ink tank 26. As the impurities are not supplied to the respective color nozzle heads 2C, 2M, 2Y and 2K of the nozzle unit 2, clogging in the respective color nozzle heads 2C, 2M, 2Y and 2K of the nozzle unit 2 due to impurities can be reliably prevented. Further, as the impurities discharged from the discharge port 17*b* of the ink tank 17 are collected in the waste ink tank 26 to collect ink (waste ink) sucked from the respective color nozzle heads 2C, 2M, 2Y and 2K of the nozzle unit 2 upon maintenance of the nozzle unit 2, it is unnecessary to provide another tank to collect impurities. Thus the size of the printer itself is not increased, and the manufacturing costs can be saved.

Further, the maintenance to maintain excellent ink discharge characteristics of the respective color nozzle heads 2C, 2M, 2Y and 2K of the nozzle unit 2 is executed whenever the nozzle unit 2 comes to a home position, for example. Accordingly, if the tube pump 28 is rotated to set the connection tube 27 to the open state at timing of the maintenance operation, depositing of large amount of impurities on the bottom surface 17*a* of the ink tank 17 with elapse of time can be prevented.

Further, in the present embodiment, as frequent ink cassette change operation as in the case of conventional small ink cassette can be omitted by replenishing ink from the ink cartridge 18 to the ink tank 17, a long-period continuous print operation can be performed.

Next, the ink jet printer according to a second embodiment of the present invention will be described with reference to FIG. 5. Note that elements corresponding to those in the above-described first embodiment have the same reference numerals and the explanations of the elements will be omitted. The difference between the present embodiment and the first embodiment is that the ink tank 17 in the first embodiment is replaced with an ink tank 30.

Figure 5:
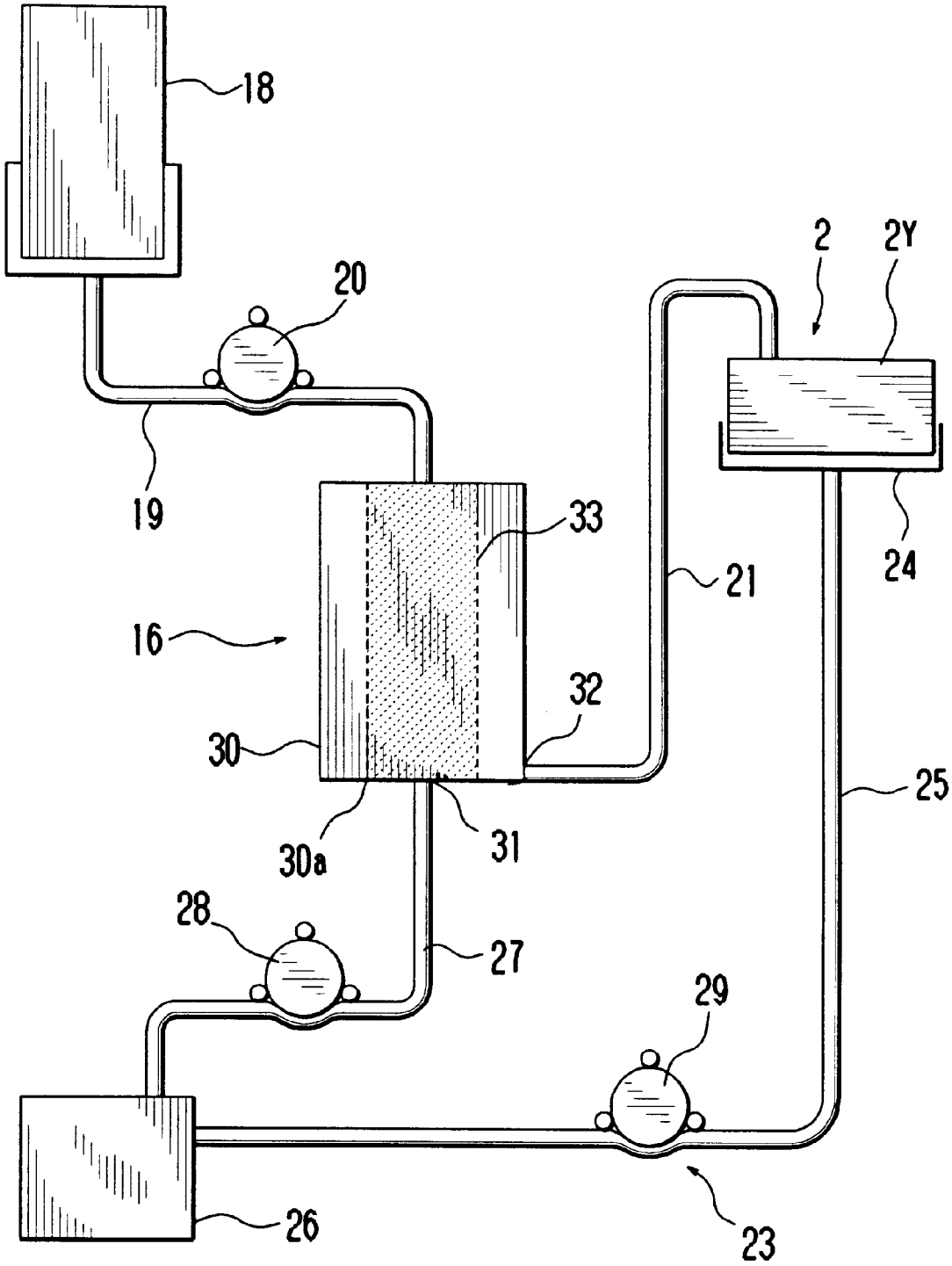
FIG. 5 is an explanatory view of the ink flow path in the ink jet printer according to a second embodiment of the present invention.

As shown in FIG. 5, the ink tank 30 has a discharge port 31 in a bottom surface 30*a* to discharge impurities deposited inside the ink tank 17 to the waste ink tank 26. The discharge port 31 is communicated with the waste ink tank 26 via the connection tube 27.

Further, an ink supply port 32 connected to the supply tube 21 is formed in a side surface of the ink tank 30 in a position near the bottom surface 30*a* of the ink tank 30. Further, a cylindrical filter 33 having a length approximately the same as that of the ink tank 30 is provided in the ink tank 30. The filter 33 eliminates impurities mixed with supplied ink passing through the filter. Note that the discharge port 31 is positioned inside the filter 33.

That is, as the ink tank 30 of the present embodiment has the filter 33 to prevent supply of impurities to the nozzle unit 2 side, the impurity depositing area as described in the first embodiment is unnecessary and the ink supply port 32 is formed in the side surface of the ink tank 30 in a position near the bottom surface 30*a* of the ink tank 30.

In this construction, the ink in the ink cartridge 18 is replenished by the tube pump 20 through the filter 33 to the ink tank 30. When the ink is discharged by control of the CPU 8 from the respective color nozzle heads 2C, 2M, 2Y and 2K of the nozzle unit 2 to a print medium (print sheet P), the ink in the ink tank 30 is automatically supplied to the ink chambers of nozzle head that discharged ink via a supply tube 21 from the ink tank 30 by a capillary phenomenon, by the decrement due to the ink discharge.

On the other hand, the impurities mixed with the ink supplied from the ink cartridge 18 to the ink tank 30 are caught inside the filter 33 and deposited on the bottom surface 30*a* of the ink tank 30 positioned inside the filter 33.

Then, the impurities deposited on the bottom surface 30*a* of the ink tank 30 positioned inside the filter 33 are discharged to the waste ink tank 26 by the impurity discharge processing as described in the first embodiment.

Next, the ink jet printer according to a third embodiment of the present invention will be described with reference to FIG. 6. Note that elements corresponding to those in the above-described first or second embodiment have the same reference numerals and the explanations of the elements will be omitted. The difference between the present embodiment and the first and second embodiments is that the ink tank 17 in the first embodiment is replaced with an ink tank 40 as a modification to the ink tank 30 used in the second embodiment.

Figure 6:
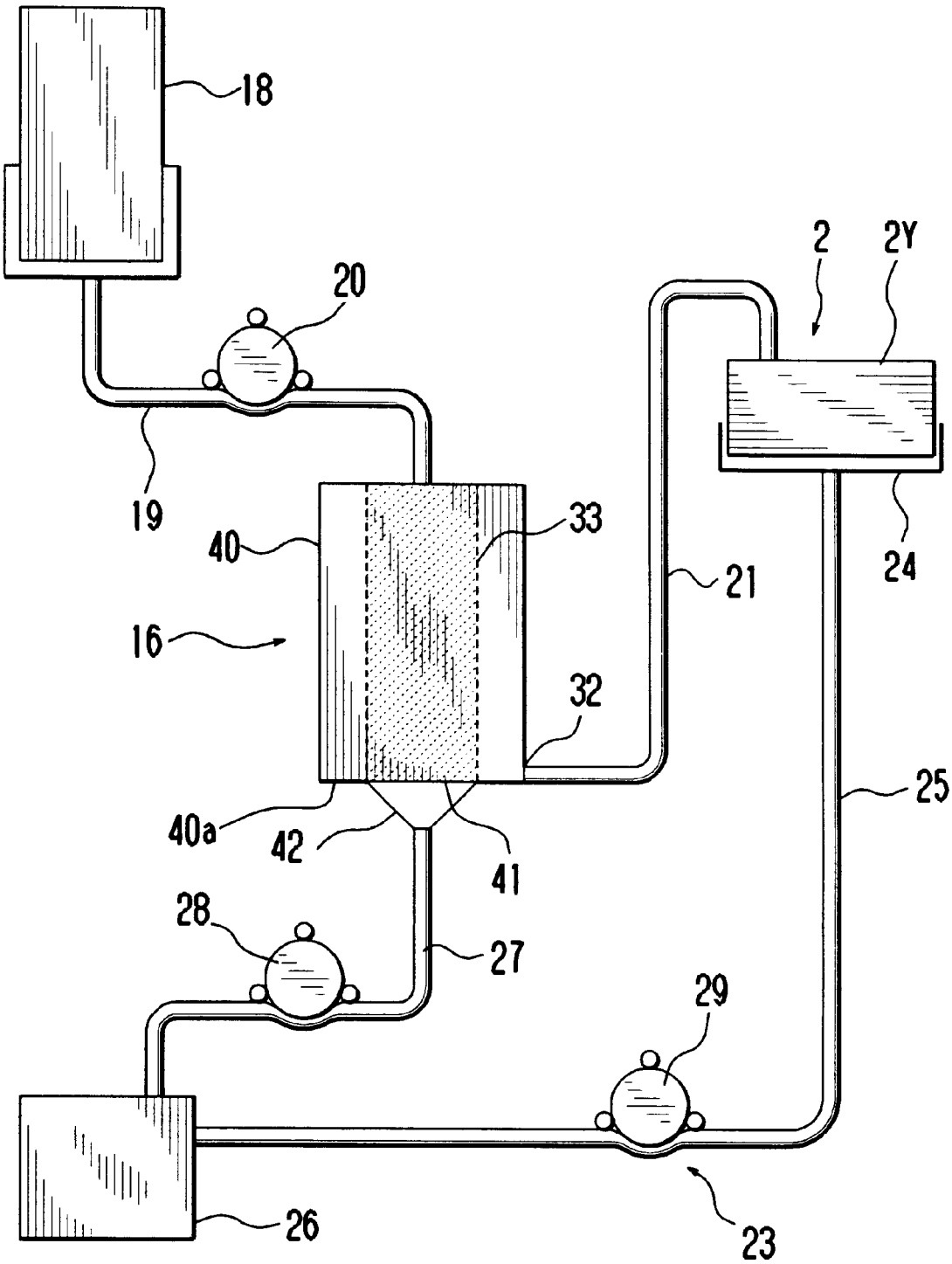
FIG. 6 is an explanatory view of the ink flow path in the ink jet printer according to a third embodiment of the present invention.

As shown in FIG. 6, the ink tank 40 of the present embodiment has a shape different from that of the ink tank 30 of the second embodiment. A discharge port 41 provided in a bottom surface 40*a* of the ink tank 40 has approximately the same shape of a cross section of the filter 33, and connected to the connection tube 27 via a conical-shaped impurity depositing portion 42.

That is, in the ink tank 40, impurities mixed with ink supplied from the ink cartridge 18 are caught inside the filter 33 and deposited in the impurity depositing portion 42.

Then, the impurities deposited in the impurity depositing portion 42 are discharged to the waste ink tank 26 by the impurity discharge processing as described in the first embodiment.

Note that in the second and third embodiments, the filter 33 is provided, and the ink supply port 32 is formed in the side surface of the ink tanks 30 and 40 in positions near the bottom surfaces 30*a* and 40*a* of the ink tanks 30 and 40, however, the ink supply port 32 may be provided in a position above the bottom surfaces 30*a* and 40*a* of the ink tanks 30 and 40 by a predetermined distance as in the case of the first embodiment. In this case, even if impurities cannot be eliminated by the filter 33, as the impurities are deposited in a position lower than the ink supply port 32, supply of the impurities to the respective color nozzle heads 2C, 2M, 2Y and 2K of the nozzle unit 2 can be prevented.

Further, in the respective embodiments, the ink jet printer of the present invention is applied to an ink jet printer which performs low-directional printing by discharging ink from respective color ink jet nozzles on a rotating print medium and performs column-directional printing by utilizing the rotation of drum upon forward movement by ink jet nozzle pitch. However, the ink jet printer is not limited to this printer, but the present invention is applicable to a so-called serial type ink jet printer.

Obviously, numerous modifications and variations of the present invention are possible in light of the above teachings. It is therefore to be understood that within the scope of the appended claims, the invention may be practiced otherwise than as specially described herein.

What is claimed is:

1. An ink jet printer, comprising:

a nozzle head having plural ink jet nozzles to allow selectively discharging ink;

an ink tank which holds the ink to be supplied to the nozzle head;

a first connection member which is connected to the ink tank and the nozzle head and connects the ink tank to the nozzle head;

a discharge port formed in a bottom surface of the ink tank and at which impurities are deposited;

a second connection member which connects the discharge port to a waste ink tank, which collects waste ink produced upon maintenance of the nozzle head, wherein the waste ink tank is at a position lower than the discharge port, and wherein the second connection member connects the ink tank to the waste ink tank; and a valve which opens/closes a part of the second connection member, wherein a connection portion of the first connection member to the ink tank is in a portion higher than the bottom surface of the ink tank.

2. An ink jet printer, comprising:

a nozzle head having plural ink jet nozzles to allow selectively discharging ink;

an ink tank which holds the ink to be supplied to the nozzle head;

a first connection member which is connected to the ink tank and the nozzle head and connects the ink tank to the nozzle head;

a discharge port formed in a bottom surface of the ink tank and at which impurities are deposited;

a second connection member which connects the discharge port to a waste ink tank, which collects waste ink produced upon maintenance of the nozzle head, wherein the waste ink tank is at a position lower than the discharge port, and wherein the second connection member connects the ink tank to the waste ink tank; and a valve which opens/closes a part of the second connection member, wherein a connection portion between the first connection member and the second connection member to the ink tank is partitioned by a filter.

3. An ink jet printer according to claim 2, wherein the filter has an upright cylindrical shape with respect to the bottom surface of the ink tank.

4. An ink jet printer according to claim 3, wherein the bottom surface of the ink tank has a dent in a portion inside a filter lower end.

5. An ink jet printer according to claim 4, wherein the dent of the bottom surface of the ink tank has a conical shape.

6. An ink jet printer according to claim 2, wherein a connection portion of the first connection member to the ink tank is positioned at the same level as that of the bottom surface of the ink tank.

7. An ink jet printer according to claim 2 wherein the filter is disposed to partition an inside of the ink tank into a first portion containing ink before filtering and a second portion containing ink after filtering, and an inlet to the ink tank and the discharge port are both disposed in the first portion.

8. An ink jet printer, comprising:

a nozzle head having plural ink jet nozzles to allow selectively discharging ink;

an ink tank which holds the ink to be supplied to the nozzle head;

a first connection member which is connected to the ink tank and the nozzle head and connects the ink tank to the nozzle head;

a discharge port formed in a bottom surface of the ink tank and at which impurities are deposited;

a second connection member which connects the discharge port to a waste ink tank, which collects waste ink produced upon maintenance of the nozzle head, wherein the waste ink tank is at a position lower than the discharge port, and wherein the second connection member connects the ink tank to the waste ink tank; and a valve which opens/closes a part of the second connection member, wherein the bottom surface of the ink tank has a dent.

9. An ink jet printer according to claim 8, wherein the dent of the bottom surface of the ink tank has a conical shape.

10. An ink jet printer according to claim 8, wherein a connection portion of the first connection member to the ink tank is positioned at the same level as that of the bottom surface of the ink tank.

11. An ink jet printer, comprising:

a nozzle head having plural ink jet nozzles to allow selectively discharging ink;

an ink tank which holds the ink to be supplied to the nozzle head;

a first connection member which is connected to the ink tank and the nozzle head and connects the ink tank to the nozzle head;

a discharge port formed in a bottom surface of the ink tank and at which impurities are deposited;

a second connection member which connects the discharge port to a waste ink tank, which collects waste ink produced upon maintenance of the nozzle head, wherein the waste ink tank is at a position lower than the discharge port, and wherein the second connection member connects the ink tank to the waste ink tank; and a valve which opens/closes a part of the second connection member, wherein a connection portion of the first connection member to the ink tank is in a position higher than the bottom surface of the ink tank.

12. An ink jet printer, comprising:

a nozzle head having plural ink jet nozzles to allow selectively discharging ink;

an ink tank which holds the ink to be supplied to the nozzle head;

a first connection member which is connected to the ink tank and the nozzle head and connects the ink tank to the nozzle head;

a discharge port formed in a bottom surface of the ink tank and at which impurities are deposited;

a second connection member which connects the discharge port to a waste ink tank, which collects waste ink produced upon maintenance of the nozzle head, wherein the waste ink tank is at a position lower than the discharge port, and wherein the second connection member connects the ink tank to the waste ink tank; and a valve which opens/closes a part of the second connection member, wherein the bottom surface of the ink tank has a dent.

* * * * *